US009543708B2

(12) United States Patent
Long

(10) Patent No.: US 9,543,708 B2
(45) Date of Patent: Jan. 10, 2017

(54) PLUGGABLE CONNECTOR AND COMMUNICATION SYSTEM CONFIGURED TO REDUCE ELECTROMAGNETIC INTERFERENCE LEAKAGE

(71) Applicant: Tyco Electronics Corporation, Berwyn, PA (US)

(72) Inventor: Richard James Long, Columbia, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 140 days.

(21) Appl. No.: 14/309,261

(22) Filed: Jun. 19, 2014

(65) Prior Publication Data

US 2015/0372428 A1 Dec. 24, 2015

(51) Int. Cl.

| | |
|---|---|
| ***H01R 9/03*** | (2006.01) |
| ***H01R 13/6582*** | (2011.01) |
| ***H01R 13/66*** | (2006.01) |
| ***H01R 24/62*** | (2011.01) |
| *H01R 107/00* | (2006.01) |

(52) U.S. Cl.

CPC ..... *H01R 13/6582* (2013.01); *H01R 13/6658* (2013.01); *H01R 24/62* (2013.01); *H01R 2107/00* (2013.01)

(58) Field of Classification Search

CPC ..... H01R 13/65802
USPC ..... 439/607.18, 939
See application file for complete search history.

(56) References Cited

U.S. PATENT DOCUMENTS

| | | | | |
|---|---|---|---|---|
| 6,718,782 | B2 * | 4/2004 | Egami | B60H 1/3222 180/53.8 |
| 7,001,217 | B2 | 2/2006 | Bright et al. | |
| 7,150,653 | B1 * | 12/2006 | Mason | H01R 13/65802 385/92 |
| 7,438,596 | B2 | 10/2008 | Phillips | |
| 7,557,306 | B2 | 7/2009 | Chen et al. | |
| 7,727,018 | B2 | 6/2010 | Bright et al. | |
| 7,967,614 | B1 * | 6/2011 | Cina | H01R 24/60 439/76.1 |
| 8,267,599 | B2 | 9/2012 | Nguyen et al. | |
| 8,444,437 | B2 | 5/2013 | Szczesny et al. | |

* cited by examiner

*Primary Examiner* — Phuongchi T Nguyen

(57) ABSTRACT

Pluggable connector including a connector housing having a leading end. The connector housing includes interior sidewalls that define a receiving space and an opening to the receiving space at the leading end. The pluggable connector also includes a contact array of electrical contacts disposed in the receiving space. The contact array is configured to engage corresponding electrical contacts of a mating connector. The pluggable connector also includes an inner electromagnetic interference (EMI) gasket that is coupled to the interior sidewalls and surrounds a portion of the interior space about the central axis. The connector housing is configured to receive the mating connector through the opening and into the receiving space when the connector housing is moved in a mating direction along the central axis. The inner EMI gasket engages the mating connector in the receiving space to electrically couple the mating connector to the connector housing.

20 Claims, 5 Drawing Sheets

PLUGGABLE CONNECTOR AND COMMUNICATION SYSTEM CONFIGURED TO REDUCE ELECTROMAGNETIC INTERFERENCE LEAKAGE

BACKGROUND

The subject matter herein relates generally to a pluggable connector and a communication system that are configured to reduce electromagnetic interference (EMI) leakage.

Pluggable I/O assemblies are used to transfer data between different communication systems or devices. Pluggable I/O assemblies include a pluggable connector and a receptacle assembly that receives and communicatively engages the pluggable connector. The pluggable connectors may be configured to transfer electrical signals or optical signals and may be configured to achieve predetermined data rates. By way of example only, known communication or industry standards for pluggable I/O assemblies include small-form factor pluggable (SFP), enhanced SFP (SFP+), quad SFP (QSFP), C form-factor pluggable (CFP), and 10 Gigabit SFP, which is often referred to as XFP.

The pluggable connector typically has a leading end where an array of electrical contacts is located. Conventional receptacle assemblies typically include a receptacle cage that has a receiving cavity and a mating connector that is positioned within the receiving cavity. The mating connector also has an array of electrical contacts and is mounted to a circuit board of the communication system. Communication systems often include a panel (or bezel) having a passage that aligns with an opening of the receiving cavity. During a mating operation, the leading end of the pluggable connector is inserted through the panel passage into the cavity opening and advanced toward the mating connector.

There has been a general demand to increase data throughput in communication systems that utilize pluggable I/O assemblies. To meet this demand, industry suppliers have increased the density of receptacle assemblies in the communication system or have increased the data rate of the pluggable I/O assemblies. In either case, it may be more difficult to contain EMI emissions. Presently, EMI emissions are contained by the receptacle cage and an EMI gasket that electrically grounds the receptacle cage to the communication system. The EMI gasket is secured to the receptacle cage near the panel passage. Although such configurations may be effective in reducing EMI leakage, the receptacle cage and the EMI gasket may increase the cost and/or the complexity of the receptacle assembly.

Accordingly, there is a need for a pluggable I/O assembly that provides a sufficient level of EMI containment while reducing at least one of the cost or complexity of the pluggable I/O assembly.

BRIEF DESCRIPTION

In an embodiment, a pluggable connector is provided that includes a connector housing having a leading end, a trailing end, and a central axis that extends between the leading and trailing ends. The connector housing includes interior sidewalls that generally face the central axis. The interior sidewalls define a receiving space and an opening to the receiving space at the leading end. The pluggable connector also includes a contact array of electrical contacts disposed in the receiving space. The contact array is configured to engage corresponding electrical contacts of a mating connector. The pluggable connector also includes an inner electromagnetic interference (EMI) gasket that is coupled to the interior sidewalls and surrounds a portion of the interior space about the central axis. The connector housing is configured to receive the mating connector through the opening and into the receiving space when the connector housing is moved in a mating direction along the central axis. The inner EMI gasket engages the mating connector in the receiving space to electrically couple the mating connector to the connector housing.

In certain embodiments, the pluggable connector also includes an outer EMI gasket that is coupled to an exterior of the connector housing and surrounds the connector housing about the central axis. The inner and outer EMI gaskets are electrically coupled to each other through the connector housing. Optionally, the inner and outer EMI gaskets are separated by an axial distance along the central axis. Also optionally, the pluggable connector may include at least one of a guide rail or a guide channel along an exterior of the connector housing that is configured to engage a complementary alignment feature to guide the pluggable connector during the mating operation.

In an embodiment, a communication system includes a system circuit board and a mating connector that is mounted to the system circuit board. The mating connector includes an insert portion having a front end of the mating connector. The communication system also includes a pluggable connector having a connector housing that includes a leading end configured to engage the front end of the mating connector. The connector housing includes interior sidewalls that define a receiving space and an opening to the receiving space at the leading end. The pluggable connector has a contact array of electrical contacts disposed in the receiving space and an inner electromagnetic interference (EMI) gasket that is coupled to the interior sidewalls and surrounds the interior space. The receiving space receives the insert portion of the mating connector during a mating operation. The inner EMI gasket engages the mating connector in the receiving space to electrically couple an outer of the mating connector to the connector housing of the pluggable connector. The leading end of the connector housing surrounds the insert portion when the pluggable connector and the mating connector are engaged.

In particular embodiments, the communication system is devoid of a receptacle cage that surrounds the pluggable connector when the mating connector and the pluggable connector are mated.

DETAILED DESCRIPTION

Figure 1:
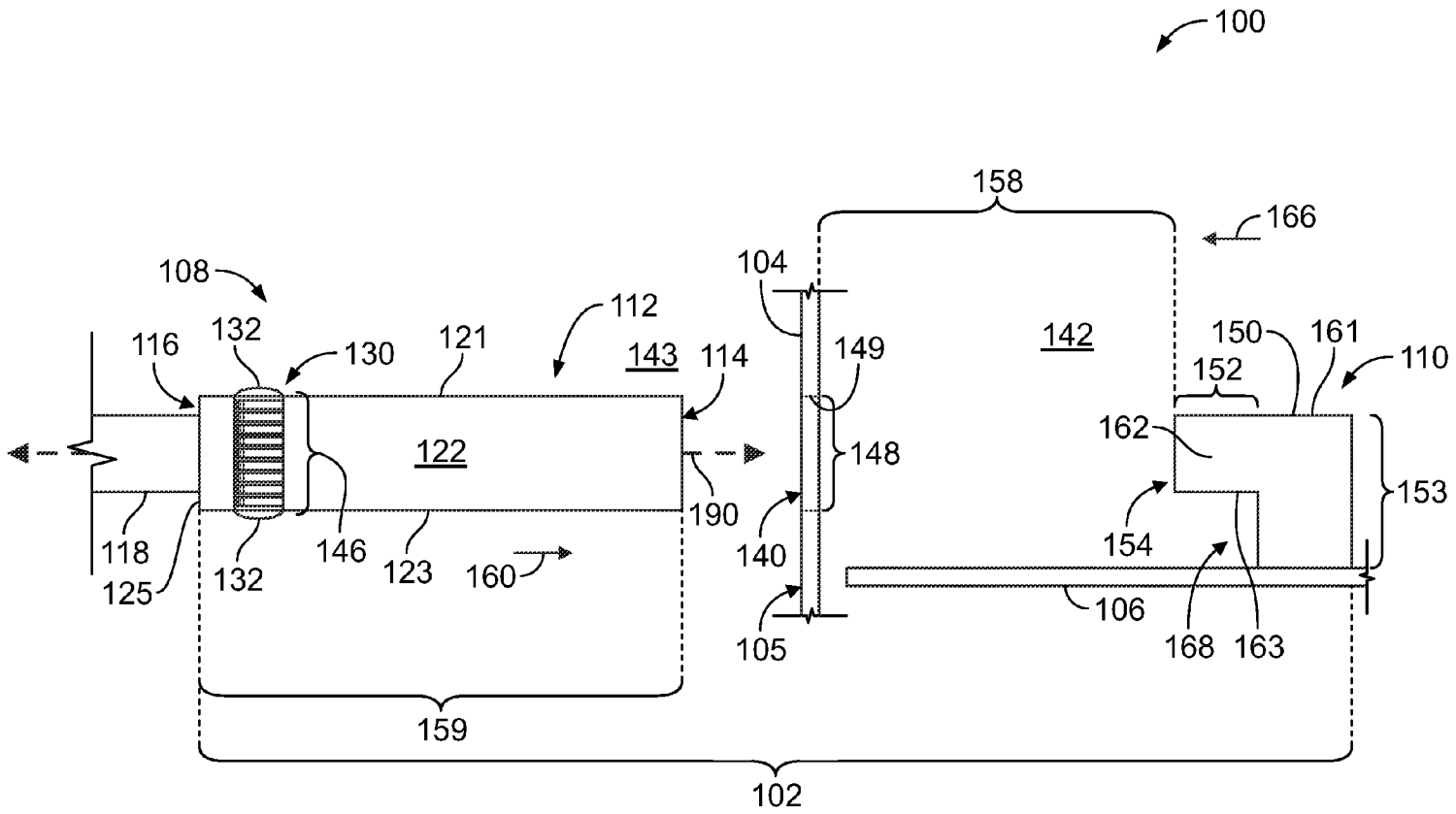
FIG. 1 is a side view of a communication system formed in accordance with an embodiment that includes a pluggable connector and a mating connector.

FIG. 1 is a side view of a communication system 100 formed in accordance with an embodiment. As shown, the communication system 100 includes a pluggable input/output (I/O) assembly 102, a panel 104, and a system circuit board 106. The pluggable I/O assembly 102 includes a pluggable connector 108 and a mating connector 110 that is configured to communicatively engage the pluggable connector 108 during a mating operation. In some applications, the pluggable connector 108 may also be referred to as a pluggable transceiver module. As shown, the mating connector 110 is mounted to the system circuit board 106 and may be electrically coupled to the system circuit board 106 for grounding and for communicating data signals. Although not shown, the system circuit board 106 may have other communication devices, such as processors, mounted thereto and may communicatively couple the mating connector 110 to the other communication devices. In an exemplary embodiment, the panel 104, the mating connector 110, and the system circuit board 106 are part of a server. However, embodiments set forth herein are not limited to server applications.

The pluggable connector 108 includes a connector housing 112 having a leading end 114, a trailing end 116, and a central axis 190 that extends between the leading and trailing ends 114, 116. The pluggable connector 108 may also include a communication cable 118 that is coupled to the connector housing 112 at the trailing end 116. The communication cable 118 is configured to transfer data signals to and/or from a contact array 242 (shown in FIG. 5) of the pluggable connector 108 that is disposed within the connector housing 112. The communication cable 118 may be permanently attached to the pluggable connector 108 or separably attached to the pluggable connector 108. In an exemplary embodiment, the communication cable 118 includes wire pairs 224 (shown in FIG. 5) that transmit electrical data signals. In other embodiments, the communication cable 118 may include one or more optical fibers that are configured to transfer data signals to the pluggable connector 108 and/or from the pluggable connector 108.

Figure 2:
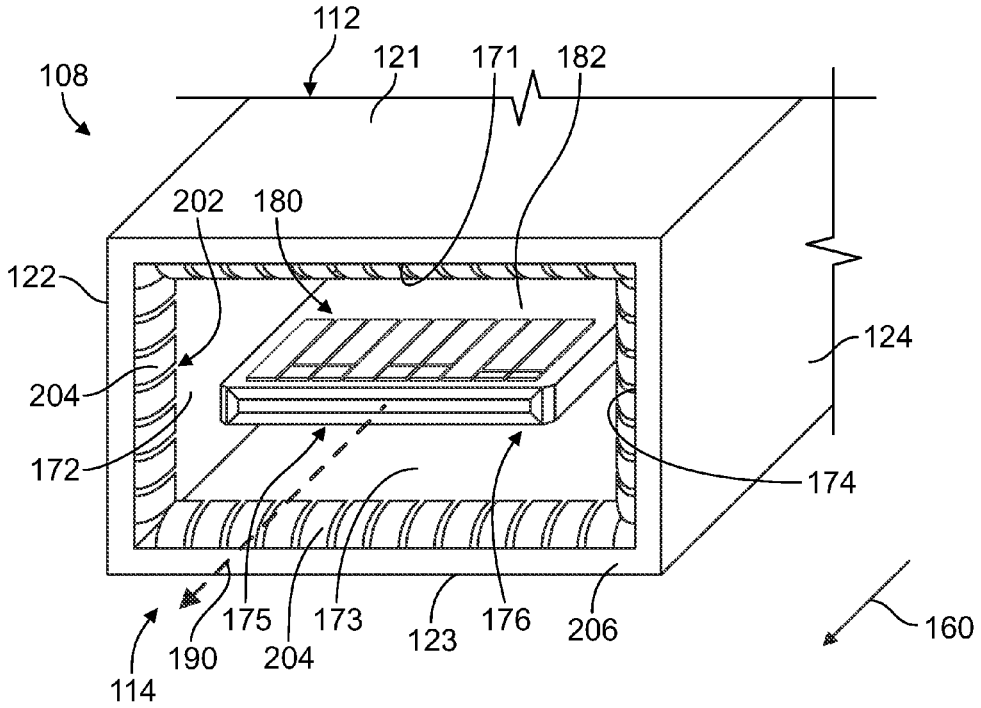
FIG. 2 is a perspective view of a portion of the pluggable connector that may be used with the communication system of FIG. 1.

The pluggable connector 108 includes internal circuitry, such as a communication sub-assembly 180 (shown in FIG. 2). During operation of the pluggable connector 108, the data signals and/or electrical power are transmitted through the internal circuitry, which may generate electromagnetic interference (EMI) emissions. As set forth herein, the pluggable connector 108 and the mating connector 110 are configured to sufficiently contain the EMI emissions generated by the internal circuitry. For example, the connector housing 112 is configured to shield or contain the EMI emissions generated by the internal circuitry. The connector housing 112 may be conductive and may surround the internal circuitry about the central axis 190. In some embodiments, the connector housing 112 may be formed from a plurality of metalized housing shells (not shown). In particular embodiments, the housing shells may be molded from a conductive material, such as a polymer that includes conductive fibers. In other embodiments, the connector housing 112 may include conductive plating that forms an exterior of the connector housing 112. The connector housing 112 may also include conductive plating that surrounds the internal circuitry within the connector housing 112. In some cases, the pluggable connector 108 and the mating connector 110 may also function to contain EMI emissions that are generated at other locations of the communication system 100.

In an exemplary embodiment, the connector housing 112 includes housing sides 121, 122, 123, and 124 (shown in FIG. 6) that extend generally parallel to the central axis 190. The connector housing 112 also has a back side 125 at the trailing end 116 that extends transverse to the central axis 190. In some embodiments, the pluggable connector 108 includes an outer EMI gasket 130 that surrounds the connector housing 112 about the central axis 190 and is coupled to the exterior of the connector housing 112. In the illustrated embodiment, the outer EMI gasket 130 includes a plurality of spring members 132 that are positioned along each of the housing sides 121-124. In other embodiments, the outer EMI gasket 130 may include an elastomeric band or loop that surrounds the connector housing 112 about the central axis 190. The outer EMI gasket 130 is formed from a conductive material that permits electrical current to flow therethrough.

The panel 104 includes a panel passage or opening 140. The pluggable connector 108 is configured to be inserted in a mating direction 160 through the panel passage 140 and into an interior space 142 of the communication system 100. The panel 104 separates the interior space 142 from an exterior space 143. The system circuit board 106 and the mating connector 110 are located within the interior space 142. The panel passage 140 is defined by an edge 149 of the panel 104. The panel passage 140 has an edge profile or shape 148 and the outer EMI gasket has a gasket profile or shape 146. In particular embodiments, the edge profile 148 and the gasket profile 146 are similar, but the edge profile 148 is slightly smaller than the gasket profile 146. For instance, the edge profile 148 and the gasket profile 146 may both be rectangular. As such, the outer EMI gasket 130 engages the edge 149 of the panel 104 when the pluggable connector 108 is mated with the mating connector 110. In other embodiments, the outer EMI gasket 130 may be held against an outer surface 105 of the panel 104 when the pluggable connector 108 is mated with the mating connector 110. In such embodiments, the outer EMI gasket 130 may have a larger gasket profile 146 and/or a different configuration than the configuration shown in FIG. 1. For example, the outer EMI gasket 130 may be an elastomeric band.

The mating connector 110 has a connector housing 150 that includes an insert portion 152 and a base portion 153. The base portion 153 is directly coupled to the system circuit board 106 and supports the insert portion 152. The insert portion 152 projects from the base portion 153 toward the panel 104 in a direction 166 that is opposite the mating direction 160. The insert portion 152 is sized and shaped relative to the base portion 153 such that a wall-receiving gap 168 exists between the insert portion 152 and the system circuit board 106. The insert portion 152 is also sized and shaped relative to the leading end 114 of the pluggable connector 108 such that the insert portion 152 may be received by a receiving space 175 (shown in FIG. 2) at the leading end 114 of the pluggable connector 108.

The insert portion 152 includes a plurality of outer sides 161, 162, 163, and 164 (shown in FIG. 6) and a front or mating end 154. The outer sides 161-164 may constitute respective outer or exterior surfaces of the mating connector 110. Although not shown, the front end 154 provides an opening to a housing cavity of the connector housing 150. Like the connector housing 112, the connector housing 150 may include a conductive material to facilitate shielding EMI emissions. For example, the connector housing 150 may be formed from housing shells (not shown) that include a conductive material. The connector housing 150 may also be plated with conductive material. In other embodiments, the mating connector 110 may include a connector cage, such as a connector cage 412 (shown in FIG. 9), which may be stamped-and-formed from sheet metal. The connector housing 150 is grounded to the system circuit board 206.

The front end 154 of the mating connector 110 may be significantly spaced apart from the panel 104. For instance, the front end 154 is located a separation distance 158 away from the panel 104. In some embodiments, the separation distance 158 may be more than one third of a length 159 of the connector housing 112. In particular embodiments, the separation distance 158 is more than one half of the length 159 of the connector housing 112. In more particular embodiments, the separation distance 158 is about two thirds of the length 159 of the connector housing 112 or more.

Figure 3:
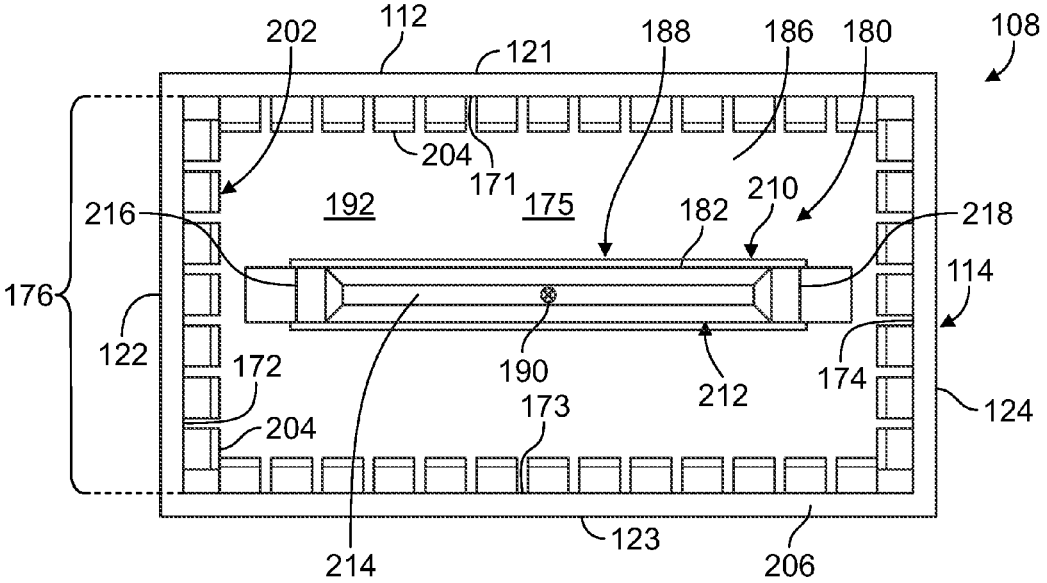
FIG. 3 is a front end view of the pluggable connector of FIG. 1.

During a mating operation, the pluggable connector 108 is aligned with the panel passage 140 and advanced in the mating direction 160 along the central axis 190. The panel passage 140 is sized and shaped to receive the pluggable connector 108. As the pluggable connector 108 moves through the panel passage 140, the leading end 114 may align with the insert portion 152 of the mating connector 110. Optionally, the pluggable connector 108 may include an alignment mechanism, such as alignment mechanisms 330, 350 (shown in FIGS. 7 and 8, respectively), that aligns the leading end 114 of the pluggable connector 108 and the front end 154 of the mating connector 110. As described herein, the leading end 114 includes an opening 176 (shown in FIGS. 2 and 3) of the receiving space 175 (FIGS. 2 and 3). The insert portion 152 is sized and shaped relative to the opening 176 such that the insert portion 152 may be received into the receiving space 175 when the pluggable connector 108 is moved in the mating direction 160 along the central axis 190. As the insert portion 152 is received by the receiving space 175, the contact array 242 (FIG. 5) may engage a corresponding contact array (not shown) within the insert portion 152 of the mating connector 110 to communicatively engage the pluggable connector 108 and the mating connector 110. When the pluggable connector 108 and the mating connector 110 are mated, the leading end 114 of the connector housing 112 surrounds the insert portion 152 and the outer EMI gasket 130 engages the panel 104. In some embodiments, the pluggable connector 108 is capable of being repeatedly inserted into and removed from the mating connector 110.

The pluggable I/O assembly 102 may be configured for various applications. Non-limiting examples of such applications include host bus adapters (HBAs), redundant arrays of inexpensive disks (RAIDs), workstations, servers, storage racks, high performance computers, or switches. The pluggable I/O assembly 102 may be configured to be compliant with certain standards, such as, but not limited to, small-form factor pluggable (SFP), enhanced SFP (SFP+), quad SFP (QSFP), C form-factor pluggable (CFP), and 10 Gigabit SFP, which is often referred to as XFP. Embodiments may be capable of transmitting at least about four (4) gigabits per second (Gbps), at least about 10 Gbps, at least about 20 Gbps, at least about 40 Gbps, or more. Although the pluggable I/O assembly 102 may be a high-speed connector in some embodiments, the pluggable I/O assembly 102 may transmit at slower transmission speeds or data rates.

FIG. 2 is a perspective view of a portion of the pluggable connector 108 that includes the leading end 114, and FIG. 3 is a front view of the leading end 114 of the pluggable connector 108. In some embodiments, the connector housing 112 surrounds and holds a communication sub-assembly 180 that includes a circuit board 182. The connector housing 112 includes a plurality of interior sidewalls 171, 172, 173, and 174 that generally face radially inward toward the central axis 190. The interior sidewalls 171-174 define the receiving space 175. The opening 176 and the receiving space 175 are sized and shaped to receive the insert portion 152 (FIG. 1). The circuit board 182 is at least partially disposed within the receiving space 175.

Also shown in FIGS. 2 and 3, the pluggable connector 108 includes an inner EMI gasket 202 that extends along the interior sidewalls 171-174. The inner EMI gasket 202 is electrically coupled to the connector housing 112. The inner EMI gasket 202 is configured to engage the insert portion 152 (FIG. 1) of the mating connector 110 (FIG. 1) when the insert portion 152 is disposed within the receiving space 175, thereby electrically coupling an outer surface of the mating connector 110 to the connector housing 112. The inner EMI gasket 202 is coupled to the interior sidewalls 171-174 and surrounds a portion of the receiving space 175 about the central axis 190. Similar to the outer EMI gasket 130 (FIG. 1), the inner EMI gasket 202 comprises a conductive material. In the illustrated embodiment, the inner EMI gasket 202 includes a plurality of resilient spring members 204 that project away from corresponding interior sidewalls 171-174 and further into the receiving space 175. Each of the interior sidewalls 171-174 has a plurality of spring members 204 coupled thereto.

The connector housing 112 may have a leading edge 206 that faces generally in the mating direction 160 (FIG. 2). The leading edge 206 extends between the housing sides 121-124 and the interior sidewalls 171-174. The leading edge 206 may represent a portion of the pluggable connector 108 that first engages or interfaces with the mating connector 110 during the mating operation. The leading edge 206 entirely surrounds the opening 176 about the central axis 190. In the illustrated embodiment, the inner EMI gasket 202 is coupled to or located proximate to the leading edge 206 in the receiving space 175. For example, the inner EMI gasket 202 may have a depth that is within five (5) millimeters or within three (3) millimeters from the leading edge 206. In other embodiments, the inner EMI gasket 202 may be positioned at a greater depth within the receiving space 175.

As shown in FIGS. 2 and 3, the spring members 204 are in relaxed or unengaged states. During the mating operation, the insert portion 152 (FIG. 1) engages and deflects the spring members 204 toward the corresponding interior sidewalls 171-174. When the pluggable connector 108 and the mating connector 110 (FIG. 1) are fully mated or engaged, the spring members 204 are in engaged states and positioned between corresponding outer sides 161-163 (FIG. 1) and 164 (FIG. 4) of the mating connector 110 and the corresponding interior sidewalls 171-174 of the pluggable connector 108. When the spring members 204 are in the engaged positions, the spring members 204 may be compressed between the corresponding outer sides 161-164 and the corresponding interior sidewall 171-174. As such, the spring members 204 may maintain mechanical and electrical contact with the insert portion 152 when the pluggable connector 108 and the mating connector 110 are mated.

With respect to FIG. 3, the circuit board 182 may be positioned within the receiving space 175 such that an insert void or space 192 surrounds the circuit board 182. For instance, the circuit board 182 includes opposite board surfaces 210, 212. The circuit board 182 also includes a mating edge 214 that is proximate to the opening 176, and side edges 216, 218 that extend generally parallel to the central axis 190. The insert void 192 exists between the board surface 210 and the interior sidewall 171, the side edge 216 and the interior sidewall 172, the board surface 212 and the interior sidewall 173, and the side edge 218 and the interior sidewall 174. The insert void 192 is configured to receive the mating connector 110 (FIG. 1). In some embodiments, the circuit board 182 is centrally positioned within the receiving space 175. For example, as shown in FIG. 3, the central axis 190 extends approximately through a geometric center of the receiving space 175 and also extends through the circuit board 182.

As shown in FIG. 3, in some embodiments, the connector housing 112 may include an interior sidewall 186. The interior sidewall 186 faces in the mating direction 160 (FIG. 2) and may include a wall opening 188. The circuit board 182 extends through the wall opening 188 and into the receiving space 175. As such, the interior sidewall 186 may surround the circuit board 182 and define a rear boundary of the receiving space 175. In alternative embodiments, the connector housing 112 does not include the interior sidewall 186.

Figure 4:
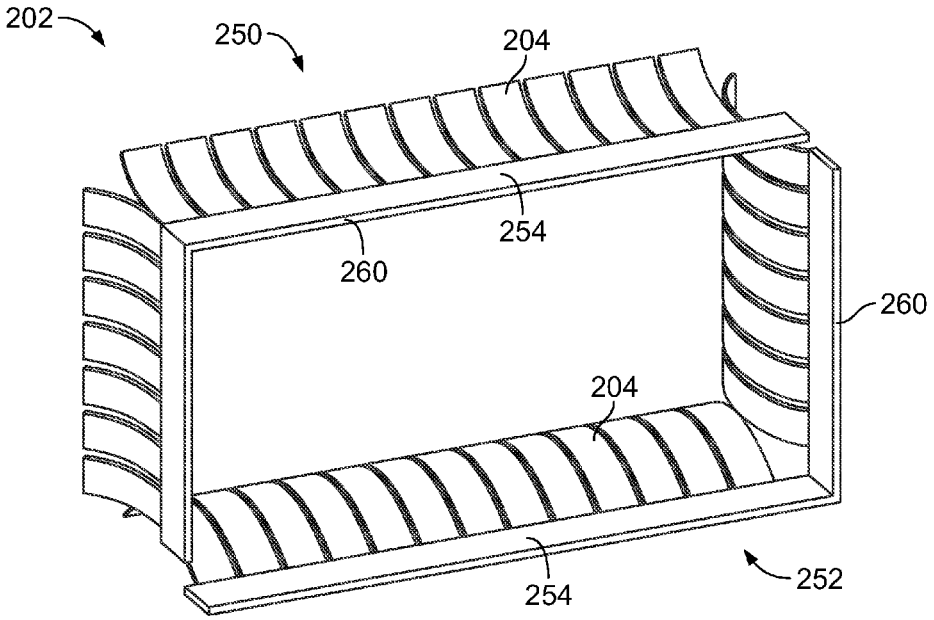
FIG. 4 is an isolated front-perspective view of an inner electromagnetic interference (EMI) gasket that may be used with the pluggable connector of FIG. 1.

FIG. 4 is an isolated front-perspective view of the inner EMI gasket 202. In some embodiments, the inner EMI gasket 202 may include separate gasket segments 250, 252 that are individually coupled to the connector housing 112 (FIG. 1). Each of the gasket segments 250, 252 includes a plurality of the spring members 204 and a base member 254 that joins the spring members 204 of the corresponding gasket segment. Each of the gasket segments 250, 252 may be a unitary piece of material that is stamped and formed to include the base member 254 and the spring members 204. In certain embodiments, the gasket segments 250, 252 are stamped and formed from conductive sheet material, such as sheet metal.

In the illustrated embodiment, the base member 254 is L-shaped and is configured to extend along two of the interior sidewalls 171-174 (FIG. 2). The base member 254 may be attached to the corresponding interior sidewalls 171-174. For example, the base members 254 may be coupled to the interior sidewalls 171-174 using an adhesive. The base members 254 may also be shaped to grip the connector housing 112 (FIG. 1). For example, the base members 254 may be shaped to form clips that engage the corresponding interior sidewalls 171-174 or the leading edge 206 (FIG. 2). More specifically, the base members 254 may have a front edge 260 and one or more projections (not shown) that extend from the front edge 260 and wrap around the leading edge 206.

In other embodiments, the inner EMI gasket 202 may include more than two gasket segments 250, 252 or, alternatively, may include only one segment that is folded to form the entire inner EMI gasket 202. Yet in other embodiments, the EMI gasket 202 is not separate from the connector housing 112. For example, the spring members 204 may be integrated with (e.g., formed with) the connector housing 112. In other embodiments, the inner EMI gasket 202 may be a conductive elastomeric band that extends along the interior sidewalls 171-174.

Figure 5:
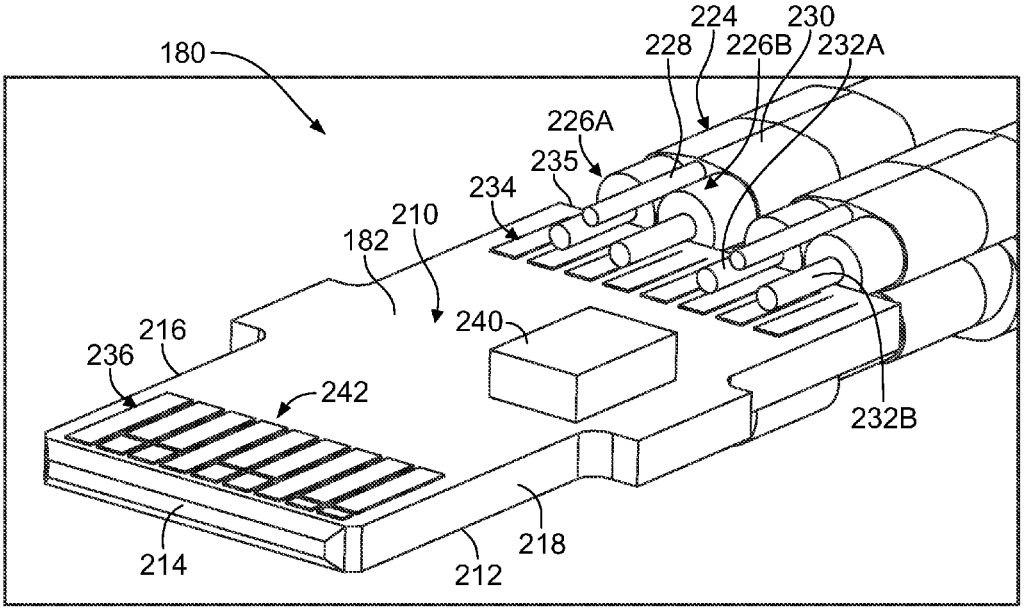
FIG. 5 is an isolated perspective view of a communication sub-assembly that may be positioned within the pluggable connector of FIG. 1.

FIG. 5 is an isolated perspective view of the communication sub-assembly 180. The communication sub-assembly 180 may generate EMI emissions or radiation during operation of the pluggable connector 108 (FIG. 1). As shown, the communication sub-assembly 180 includes the circuit board 182 and a plurality of wire pairs 224 of a corresponding communication cable 118 (FIG. 1). The wire pairs 224 are terminated to the circuit board 182. In the illustrated embodiment, a total of four wire pairs 224 are terminated to the circuit board 182 with each board surface 210, 212 engaging two of the wire pairs 224. Each of the wire pairs 224 includes a pair of insulated wires 226A, 226B and a ground conductor 228 that are surrounded by a common jacket 230. The wire pairs 224 are stripped to expose the ground conductor 228 and wire conductors 232A, 232B of the insulated wires 226A, 226B, respectively.

The wire conductors 232A, 232B are configured to transmit data signals and are terminated to electrical contacts 234 that extend along a back edge 235 of the circuit board 182. Although not shown, the ground conductors 228 may be terminated to one of the electrical contacts 234 or other grounding feature (not shown). The electrical contacts 234 are electrically coupled to electrical contacts 236 through the circuit board 182. In the illustrated embodiment, the electrical contacts 234 and 236 are contact pads. The electrical contacts 236 form the contact array 242 and are positioned proximate to the mating edge 214 between the side edges 216, 218. The mating edge 214 and the back edge 235 face in opposite directions. The mating edge 214 is configured to engage the mating connector 110 (FIG. 1).

In the illustrated embodiment, the contact array 242 is part of the circuit board 182. In alternative embodiments, the contact array 242 may be formed from electrical contacts that are not part of a circuit board. Also shown, the circuit board 182 may include a processing unit 240 mounted thereto. The processing unit 240 may constitute a chip or other circuitry that is capable of processing data signals to execute one or more functions of the pluggable connector 108 (FIG. 1). The processing unit 240 may be communicatively coupled to one or more of the electrical contacts 236.

In an exemplary embodiment, the communication sub-assembly 180 is configured to receive and/or transmit electrical signals through the communication cable 118 (FIG. 1). In alternative embodiments, the communication sub-assembly 180 may be configured to receive and/or transmit optical signals. In such embodiments, the communication cable 118 may include optical fibers that transmit optical signals. The communication sub-assembly 180 may include an optical engine (not shown) that converts the optical signals to electrical signals or vice versa. In such embodiments, the communication sub-assembly 180 may also include processing units, such as the processing unit 240, that facilitate converting and/or modifying the signals.

Figure 6:
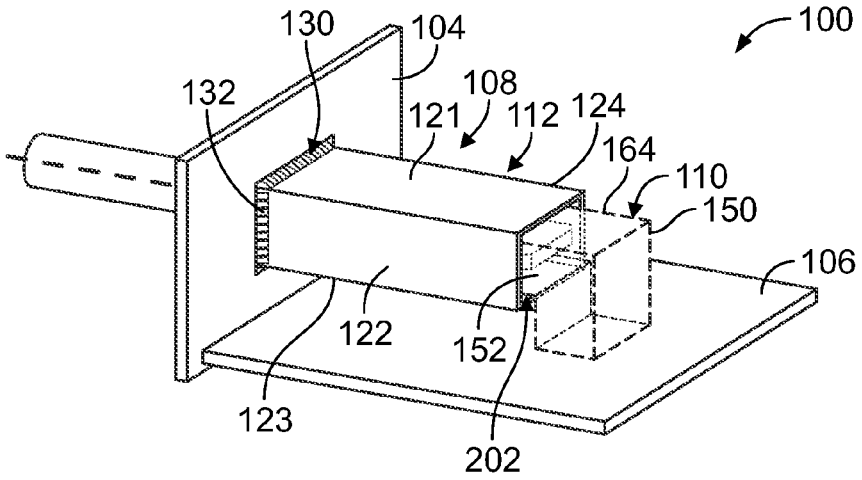
FIG. 6 is a perspective view of the communication system of FIG. 1 in which the pluggable connector and the mating connector are mated to each other.

FIG. 6 is a perspective view of the communication system 100 in which the pluggable connector 108 and the mating connector 110 are fully mated and capable of transmitting data signals through the communication system 100. As shown, the outer EMI gasket 130 is engaged to the panel 104 and electrically connects the panel 104 to the connector housing 112 of the pluggable connector 108. At the same time, the inner EMI gasket 202 is engaged to the insert portion 152 of the mating connector 110. The mating connector 110 is mounted and grounded to the system circuit board 106. Accordingly, while the mating connector 110 and the pluggable connector 108 are communicatively coupled for transmitting data signals, the pluggable I/O assembly 102 may provide a ground pathway between the system circuit board 106 and the panel 104 through the connector housing 112 and the connector housing 150. The ground pathway may be used for EMI containment. As shown in FIG. 6, the communication system 100 may be devoid of a receptacle cage that receives and encloses the pluggable connector 108 and the mating connector 110. Unlike some conventional pluggable I/O assemblies, the pluggable connector 108 is exposed to the interior space 142 within the communication system 100.

When the pluggable connector 108 and the mating connector 110 are mated, the spring members 132 are deflected toward the corresponding housing sides 121-124, and the spring members 204 (FIG. 2) are deflected toward the corresponding interior sidewalls 171-174 (FIG. 2). Potential energy stored within the spring members 132 may maintain a mechanical and electrical engagement between the panel 104 and the connector housing 112. Likewise, potential energy stored within the spring members 204 may maintain a mechanical and electrical engagement between the mating connector 110 and the connector housing 112.

Figure 7:
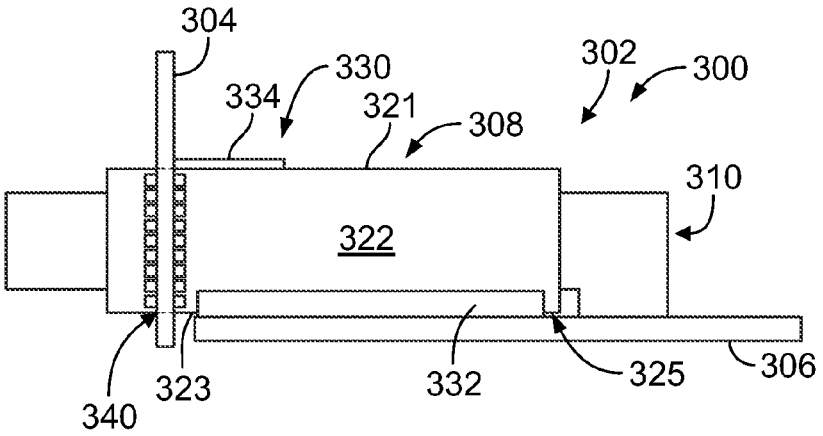
FIG. 7 is a side view of a communication system formed in accordance with an embodiment that includes an alignment mechanism.

FIG. 7 is a side view of a communication system 300 in accordance with an embodiment. The communication system 300 may include identical or similar components and features as the communication system 100 (FIG. 1). For example, the communication system 300 includes a pluggable I/O assembly 302 having a pluggable connector 308 and a mating connector 310. The communication system 300 also includes a panel 304 and a system circuit board 306. As shown, the pluggable connector 308 extends through a panel passage 340 and is fully mated with the mating connector 310.

The communication system 300 also includes an alignment mechanism 330. In the illustrated embodiment, the alignment mechanism 330 includes a guide rail 332 and a guide wall 334. In alternative embodiments, the alignment mechanism 330 includes only the guide rail 332 or only the guide wall 334. During the mating operation, a corner 325 that is defined by a housing side 322 and a housing side 323 of the pluggable connector 308 may slidably engage the guide rail 332. To this end, the guide rail 332 may be L-shaped. A housing side 321 may slidably engage the guide wall 334. Each of the guide rail 332 and the guide wall 334 are shaped to guide the pluggable connector 308 along a designated path toward the mating connector 310 during the mating operation. The panel 304 and the system circuit board 306 may also direct the pluggable connector 308 toward the mating connector 310 during the mating operation.

In the illustrated embodiment, the guide rail 332 extends along the system circuit board 306 between the panel 304 and the mating connector 310. Alternatively, the guide rail 332 may extend above the pluggable connector 308 along the housing side 321. In one embodiment, each of the four corners 325 of the pluggable connector 308 may be directed by a corresponding guide rail 332. In alternative embodiments, the alignment mechanism 330 includes a plurality of the guide walls 334. For example, the alignment mechanism 330 may include three guide walls 334 that each engage a corresponding housing side to direct the pluggable connector 308 to the mating connector 310. Although the above was described with reference to the communication system 300, the communication system 100 may also incorporate an alignment mechanism.

Figure 8:
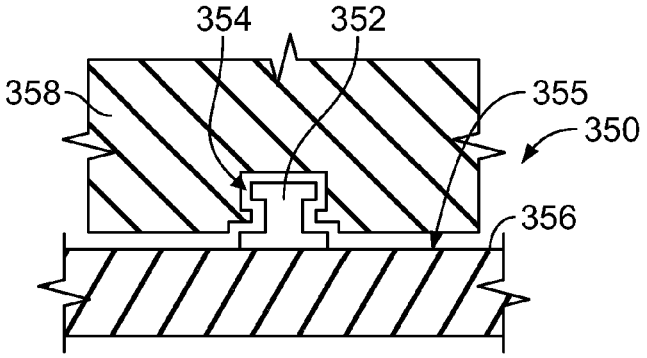
FIG. 8 is a cross-section of an alignment mechanism that may be used with one or more embodiments.

FIG. 8 is a cross-section of an alignment mechanism 350 that may be used with one or more embodiments. The alignment mechanism 350 includes a guide rail 352 and a guide channel or groove 354. The guide rail 352 is coupled to a board surface 355 of a system circuit board 356, and the guide channel 354 is coupled to or part of a connector housing 358 of a pluggable connector (not shown). For example, the guide channel 354 may be coupled to the housing side 123 (FIG. 1) of the pluggable connector 108 (FIG. 1) or the housing side 323 (FIG. 7) of the pluggable connector 308 (FIG. 7). The guide rail 352 and the guide channel 354 are sized and shaped with respect to each other to direct the pluggable connector along a designated path. During a mating operation, the guide channel 354 receives the guide rail 352, and the guide rail 352 directs the pluggable connector toward a mating connector (not shown). In alternative embodiments, the system circuit board 356 may include a guide channel and the connector housing 358 may include a guide rail.

Figure 9:
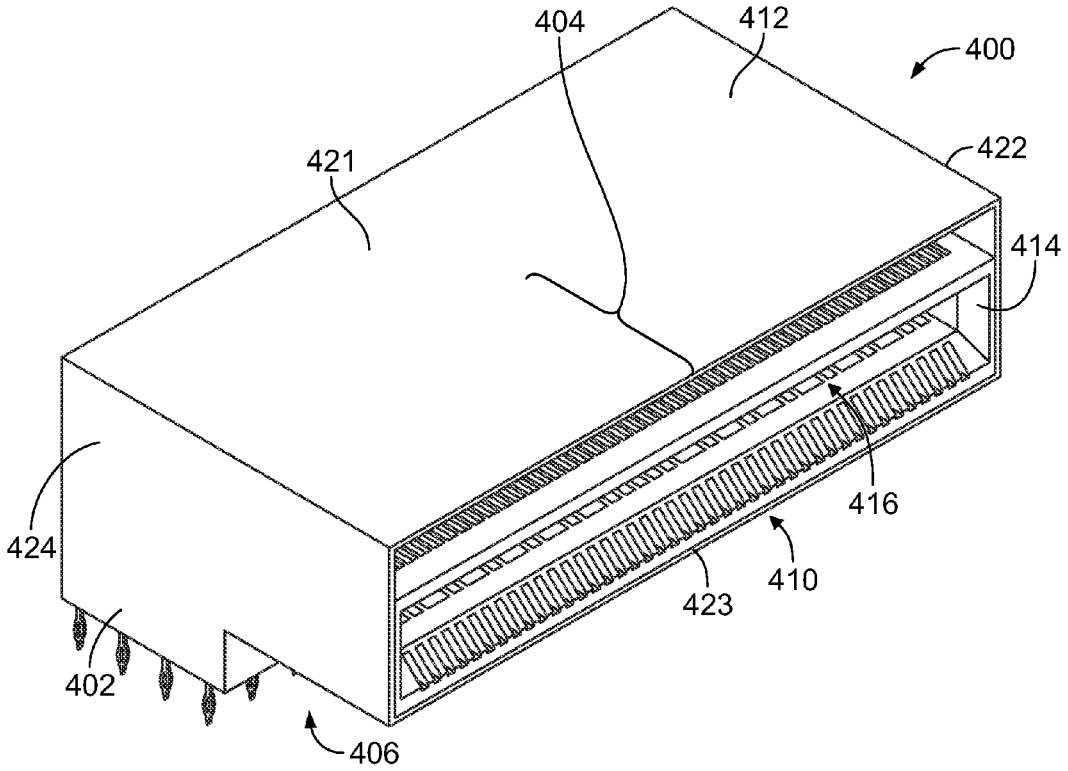
FIG. 9 is a perspective view of a mating connector that includes a connector cage in accordance with an embodiment.

FIG. 9 is a perspective view of a mating connector 400, which may be similar to the mating connector 110 (FIG. 1) and the mating connector 310 (FIG. 7). For example, the mating connector 400 is configured to engage a pluggable connector (not shown), such as the pluggable connector 108 (FIG. 1) and the pluggable connector 308 (FIG. 7). The mating connector 400 includes a base portion 402 and an insert portion 404 that is supported by the base portion 402. The base portion 402 is configured to be mounted to a system circuit board (not shown). A wall-receiving recess 406 exists under the insert portion 404 and forms a wall-receiving gap when the mating connector 400 is mounted to the system circuit board. The mating connector 400 has a front end 410 that is configured to engage the pluggable connector. Similar to other embodiments described herein, the front end 410 may be received by a receiving space (not shown) of the pluggable connector.

Also shown in FIG. 9, the mating connector 400 includes a connector cage 412 and a dielectric housing 414. The connector cage 412 surrounds the dielectric housing 414 and includes outer sides 421, 422, 423, and 424. Each of the outer sides 421-424 is configured to engage an inner EMI gasket (not shown) of the pluggable connector during the mating operation. Also shown, the dielectric housing 414 forms a board slot 416. The board slot 416 is configured to receive a circuit board (not shown) of the pluggable connector, which may be similar to the circuit board 182 (FIG. 2). The mating connector 400 includes electrical contacts (not shown) that engage the circuit board of the pluggable connector during the mating operation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A pluggable assembly comprising:

a pluggable connector configured to move in a mating direction toward and to pluggably engage a mating connector of a communication system, the pluggable connector comprising:

a connector housing having a leading end, a trailing end, and a central axis that extends between the leading and trailing ends, the connector housing including interior sidewalls that generally face the central axis, the interior sidewalls defining a receiving space and an opening to the receiving space at the leading end;

a contact array of electrical contacts disposed in the receiving space, the contact array configured to engage corresponding electrical contacts of the mating connector, the contact array positioned to be inserted into a slot of the mating connector; and an inner electromagnetic interference (EMI) gasket coupled to the interior sidewalls and surrounding a portion of the interior space about the central axis, wherein the connector housing is configured to receive the mating connector into the receiving space when the connector housing is moved in the mating direction along the central axis, the inner EMI gasket engaging the mating connector in the receiving space to electrically couple the mating connector to the connector housing, wherein the connector housing is conductive and the inner EMI gasket is electrically coupled to the connector housing;

wherein the trailing end of the connector housing is either attached to a communication cable of the pluggable assembly or is configured to be separably attached to the communication cable, the communication cable configured to transmit electrical signals or optical signals.

2. The pluggable assembly of claim 1, wherein the inner EMI gasket includes spring members that are coupled to corresponding interior sidewalls and project into the receiving space, the spring members being deflected by the mating connector toward the corresponding interior sidewalls when the mating connector is received in the receiving space.

3. The pluggable assembly of claim 1, further comprising an outer EMI gasket that is coupled to an exterior of the connector housing and surrounds the connector housing about the central axis, the inner and outer EMI gaskets being electrically coupled to each other through the connector housing, wherein the inner EMI gasket is positioned closer to the leading end than the trailing end and the outer EMI gasket is positioned closer to the trailing end than the leading end.

4. The pluggable assembly of claim 1, wherein the connector housing includes a leading edge that defines the opening to the receiving space, the EMI gasket being coupled to or located proximate to the leading edge.

5. The pluggable assembly of claim 1, wherein the pluggable connector includes at least one of a guide rail or a guide channel along an exterior of the connector housing that is configured to engage a complementary alignment feature to guide the pluggable connector during a mating operation.

6. The pluggable assembly of claim 1, wherein the pluggable connector is a high-speed connector capable of transmitting data signals at 10 gigabits per second or more.

7. The pluggable assembly of claim 1, wherein an exterior surface of the connector housing that is closer to the trailing end than the leading end is conductive.

8. The pluggable assembly of claim 1, wherein the contact array is positioned proximate to the leading end for mating with the mating connector, the pluggable assembly further comprising a communication sub-assembly having a circuit board that is electrically coupled to the contact array, the communication subassembly including one or more processing units coupled to the circuit board that are configured to process data signals transmitting through the pluggable connector.

9. The pluggable assembly of claim 1, further comprising a communication sub-assembly having a circuit board that includes the contact array, the circuit board being disposed within the receiving space.

10. The pluggable assembly of claim 9, wherein the communication subassembly includes one or more processing units coupled to the circuit board.

11. A communication system comprising:

a system circuit board;

a mating connector mounted to the system circuit board, the mating connector including an insert portion having a front end of the mating connector;

a pluggable connector having a connector housing that includes a leading end configured to engage the front end of the mating connector, the connector housing including interior sidewalls that define a receiving space and an opening to the receiving space at the leading end, the pluggable connector including a contact array of electrical contacts disposed in the receiving space and an inner electromagnetic interference (EMI) gasket that is coupled to the interior sidewalls, the EMI gasket surrounding a portion of the interior space, wherein the receiving space receives the insert portion of the mating connector during a mating operation, the inner EMI gasket engaging the mating connector in the receiving space to electrically couple the mating connector to the connector housing of the pluggable connector, the leading end of the connector housing surrounding the insert portion when the pluggable connector and the mating connector are mated; and a panel having a panel passage that is aligned with the front end of the mating connector, the front end being spaced from the panel by a separation distance.

12. The communication system of claim 11, wherein the mating connector includes a base portion that supports the insert portion, the insert portion projecting from the base portion along the system circuit board to form a wall-receiving gap between the insert portion and the system circuit board, the pluggable connector advancing into the wall-receiving gap during the mating operation.

13. The communication system of claim 11, wherein the separation distance is more than one third of a length of the connector housing of the pluggable connector.

14. The communication system of claim 11, wherein the inner EMI gasket includes spring members that are coupled to corresponding interior sidewalls of the connector housing and project into the receiving space, the spring members being deflected by the mating connector toward the corresponding interior sidewalls when the mating connector is received in the receiving space.

15. The communication system of claim 11, further comprising an alignment mechanism that includes at least one of a guide rail, a guide wall, or a guide channel for directing the pluggable connector to the mating connector during the mating operation.

16. The communication system of claim 11, wherein the communication system is devoid of a receptacle cage that surrounds the pluggable connector when the mating connector and the pluggable connector are mated.

17. The communication system of claim 11, wherein the pluggable connector further comprises an outer EMI gasket that is coupled to an exterior of the connector housing and surrounds the connector housing.

18. The communication system of claim 17, wherein the connector housing is oriented with respect to a central axis that extends between the leading end and a trailing end of the connector housing, the inner and outer EMI gaskets have different positions relative to the central axis such that the inner EMI gasket is positioned closer to the leading end than the trailing end and the outer EMI gasket is positioned closer to the trailing end than the leading end.

19. The communication system of claim 17, further comprising a panel having a panel passage that receives the pluggable connector, the outer EMI gasket being engaged to the panel when the pluggable connector and the mating connector are mated, wherein the inner and outer EMI gaskets and the connector housing form a ground pathway between the mating connector and the panel.

20. A communication system comprising:

a system circuit board;

a mating connector mounted to the system circuit board, the mating connector including an insert portion having a front end of the mating connector;

a pluggable connector having a connector housing that includes a leading end configured to engage the front end of the mating connector, the connector housing including interior sidewalls that define a receiving space and an opening to the receiving space at the leading end, the pluggable connector including a contact array of electrical contacts disposed in the receiving space and an inner electromagnetic interference (EMI) gasket that is coupled to the interior sidewalls, the EMI gasket surrounding a portion of the interior space, wherein the receiving space receives the insert portion of the mating connector during a mating operation, the inner EMI gasket engaging the mating connector in the receiving space to electrically couple the mating connector to the connector housing of the pluggable connector, the leading end of the connector housing surrounding the insert portion when the pluggable connector and the mating connector are mated; and a communication sub-assembly that includes a circuit board having the contact array, the circuit board being disposed within the receiving space of the pluggable connector, the mating connector having a board slot that receives the circuit board during the mating operation.

* * * * *